US006536247B2

(12) United States Patent
Huang

(10) Patent No.: US 6,536,247 B2
(45) Date of Patent: Mar. 25, 2003

(54) SEAT DEVICE OF A KEY RING

(76) Inventor: Yu-Hwei Huang, No. 8, Lane 42, Sec. 2, Nan Kan Rd., Lu Chu Hsiang, Tao Yuan Hsien (TW)

( * ) Notice: Subject to any disclaimer, the term of this patent is extended or adjusted under 35 U.S.C. 154(b) by 0 days.

(21) Appl. No.: 09/816,444

(22) Filed: Mar. 26, 2001

(65) Prior Publication Data

US 2002/0134123 A1 Sep. 26, 2002

(51) Int. Cl.[7] ..... A47G 29/10
(52) U.S. Cl. ..... 70/456 R; 70/459; D3/61
(58) Field of Search ..... 70/456 R–459; 24/3 K; D3/207–212, 61–65

(56) References Cited

U.S. PATENT DOCUMENTS 3,100,608 A * 8/1963 Goldfarb ..... 70/456 R X
4,584,858 A * 4/1986 Wolter ..... 70/456 R
4,592,219 A * 6/1986 Richter ..... 70/456 R
D308,292 S * 6/1990 Lui ..... D3/61
D308,754 S * 6/1990 Lui ..... D3/63
5,154,073 A * 10/1992 Huang ..... 70/456 R
5,224,366 A * 7/1993 Huang ..... 70/456 R
D370,339 S * 6/1996 Pinchuk ..... D3/208
D374,976 S * 10/1996 MacDonald ..... D3/207
6,006,562 A * 12/1999 Wolter ..... 70/456 R
6,332,345 B1 * 12/2001 Huang ..... 70/456 R

* cited by examiner

*Primary Examiner*—Suzanne Dino Barrett
(74) *Attorney, Agent, or Firm*—Rosenberg, Klein & Lee

(57) ABSTRACT

A seat device of a key ring comprises a seat. The seat has an oblong shape, and an interior of the seat having a cruciform recess. One end of the sliding groove is formed with an opening and a movable opening can be formed through a control device. A movable track is formed interior the recess and near one end thereof for being connected to key rings. Thereby, the movable opening is installed at the middle portion of the movable track so that the key rings can be taken out easily and the user may take out any key ring from the opening at the middle portion.

2 Claims, 8 Drawing Sheets

SEAT DEVICE OF A KEY RING

FIELD OF THE INVENTION

The present invention relates to a seat device of a key ring, and especially to a seat device having an opening at a middle of a movable track so that the key hanging ring can be taken out easily. The user may take out any key hanging ring from the opening at a middle portion.

BACKGROUND OF THE INVENTION

Prior art key rings may can be used to locate a plurality of key hanging rings for being disposed with a plurality of keys. As desired, the key hanging rings can be taken out from or placed in the key ring so that the number of the key hanging ring can be adjusted as desired.

Referring to FIG. 1, the prior art key ring includes a seat 10*a,* key hanging rings 12*a* and a control device 12*a*. The seat 10*a* has an oblong shape and is connected to a key hanging ring 11*a*. Each key hanging ring 11*a* has an arm 13*a* and a head 14*a*. The key hanging ring 11*a* serves to hang keys. One end of the oblong seat 10*a* is installed with a movable track 15*a*. The head 14*a* is movably mounted to the movable track 15*a* of the seat 10*a*. One end of the movable track 15*a* is installed with a movable opening 16*a*. Through the opening 16*a,* the head 14*a* can be taken out from or placed in the movable track 15*a*. The movable opening 16*a* is formed by an enlarged end of the movable track 15*a* and is faced outwards. The control device 12*a* may be used to reduce the cross section of the movable opening 16*a* so as to be smaller than the cross section of the head 14*a*. Therefore, the movable opening 16*a* can be closed. Therefore, the head 14*a* is prevented from releasing from the movable opening 16*a*.

When the control device 12*a* is pushed toward another direction, the movable opening 16*a* can be opened, so that the head 14*a* and the arm 13*a* may pass through the channel. As a result, the head 14*a* of the key hanging ring 11*a* may be taken out from or placed into the movable track 15*a*. Consequently, the user may adjust the number of the key hanging ring 11*a* as desired.

However, in the seat 10*a* of aforesaid prior art key rings, since the movable opening 16*a* is installed at one end of the movable track 15*a;* when a plurality of key hanging ring 11*a* are disposed on the seat 10*a* and the key hanging ring 11*a* to be taken out is placed at another end of the movable track 15*a,* farther from the movable opening 16*a,* all the key hanging rings 11*a* must be taken out for taking the key hanging ring 11*a* out at a farther end of the movable opening 16*a*. Therefore, the operation is time-consumed and inconvenient as the user is desired to taken out a key hanging ring 11*a*.

SUMMARY OF THE INVENTION

Accordingly, the primary object of the present invention is to provide a seat device of a key ring, wherein the key ring of the present invention has a movable opening being installed in the movable track. When a plurality of key rings are positioned in the seat and one of the key rings is to be taken out, that is, the key ring to be taken out is placed at one end of the movable track, it is only necessary to push other key rings to another end of the movable track, then the key ring to be taken out can be taken out from the movable opening. Therefore, the key ring can be taken out easily, and the operation is time and labor saved. Any key ring can be taken out from the opening at the middle section.

To achieve the aforesaid object, the present invention provides a seat device of a key ring comprising a seat. The seat has an oblong shape, and an interior of the seat having a cruciform recess. One end of the sliding groove is formed with an opening and a movable opening can be formed through a control device. A movable track is formed interior the recess and near one end thereof for being connected to key rings. Thereby, the movable opening is installed at the middle portion of the movable track so that the key rings can be taken out easily and the user may take out any key ring from the opening at the middle portion.

The various objects and advantages of the present invention will be more readily understood from the following detailed description when read in conjunction with the appended drawing.

DETAILED DESCRIPTION OF THE PREFERRED EMBODIMENTS

To further understand the present invention, a detail description of the present invention will be described in the following with the appended drawings. Those skilled in the art may completely understand the objects, characteristics and features of the present invention from these descriptions. However, those descriptions and the appended drawings are only used to describe the present invention instead of being used to confine the spirit and scope of the present invention defined in the appended claims.

Figure 1:
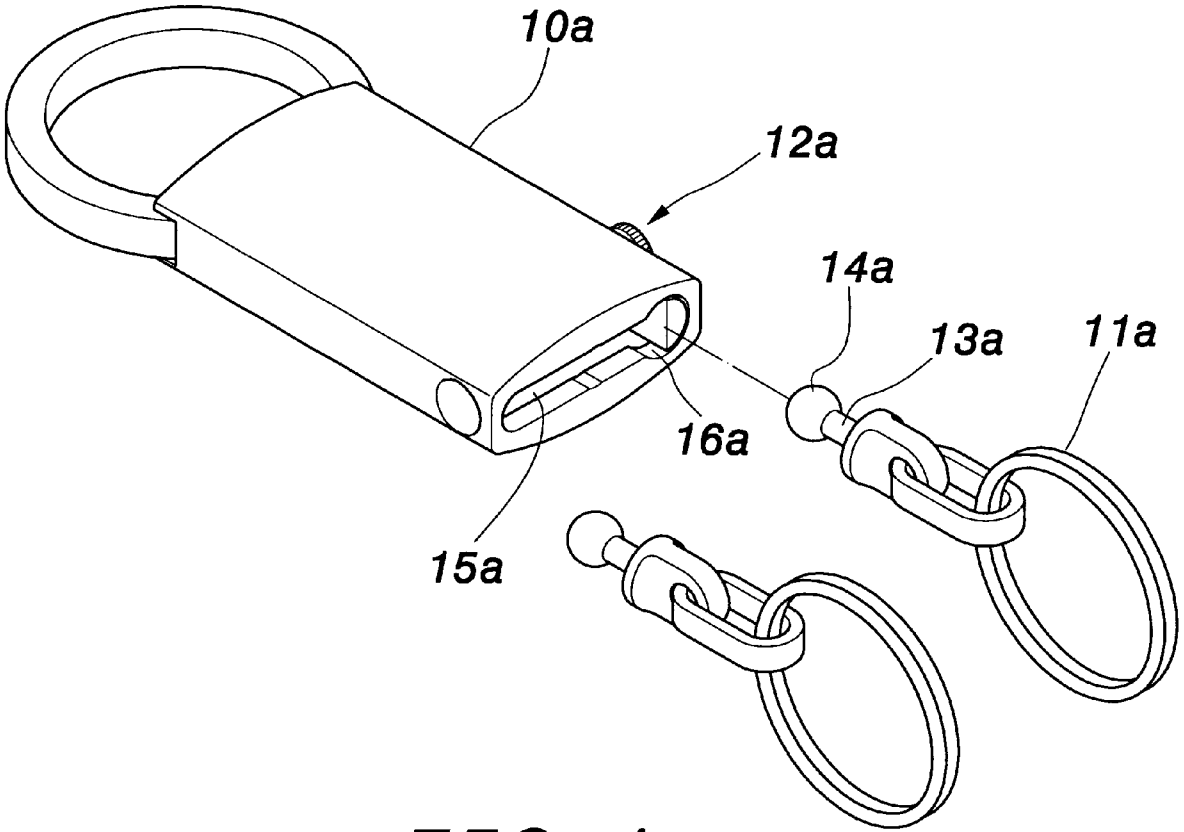
FIG. 1 PRIOR ART
FIG. 1 is a perspective view of the prior art key ring.
Figure 2:
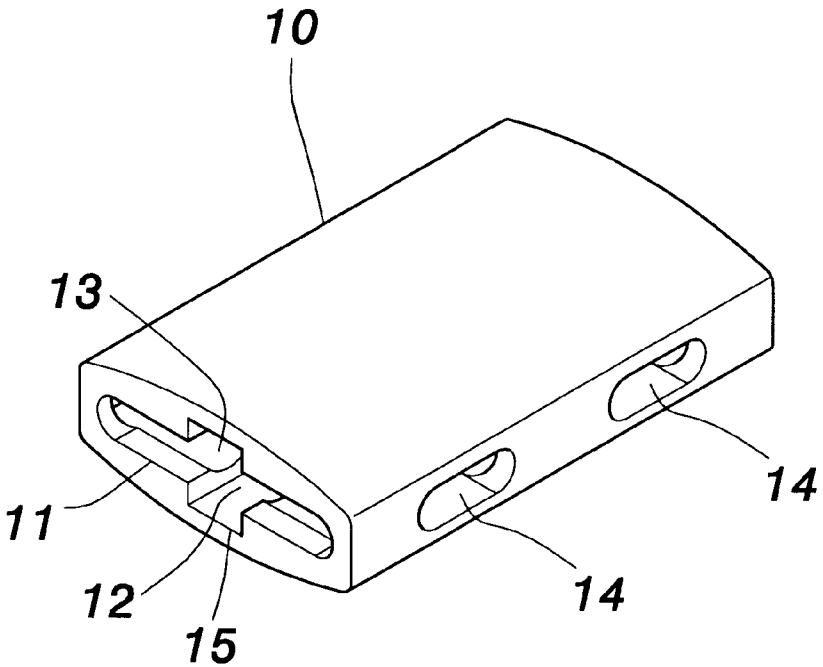
FIG. 2 is a perspective view of the seat of the key ring in the present invention.
Figure 3:
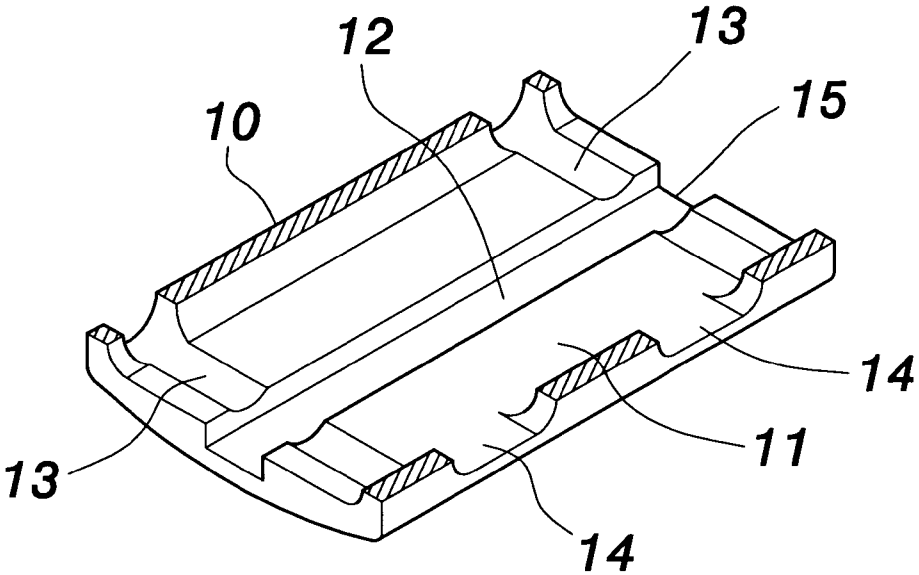
FIG. 3 is a cross sectional view of the seat of the key ring in the present invention.

Referring to FIGS. 2 and 3, the seat device of a key ring of the present invention is illustrated. The seat device of a key ring includes a seat 10. The seat 10 has an oblong shape, and the front side and rear side thereof have a cambered shape so as to present a beautiful outlook. The front side and rear side of the seat 10 have larger areas for being printed with characters or patterns about trademarks and advertisements. The interior of the seat 10 is formed with a cruciform recess 11. The recess 11 extends along the longitudinal direction of the seat 10 so as to penetrate the upper and lower ends of the seat 10. The middle portion of the recess 11 has a sliding groove 12 with a larger width. One or two ends of the sliding groove 12 are installed with openings 15 which is communicate-able with external environments. One or two ends in the interior of the recess 11 are installed with movable tracks 13, respectively. The movable track 13 is transversally extended along the seat 10 and has a round cross section. The movable tracks 13 are orthogonal to the sliding groove 12. Furthermore, one side of the seat 10 is formed with one or two long push button through holes 14. The through holes 14 extend with a predetermined length longitudinally along the seat 10. The through holes 14 penetrate the interior of the recess 11. By the aforesaid components, the seat device of a key ring of the present invention is formed.

Figure 4:
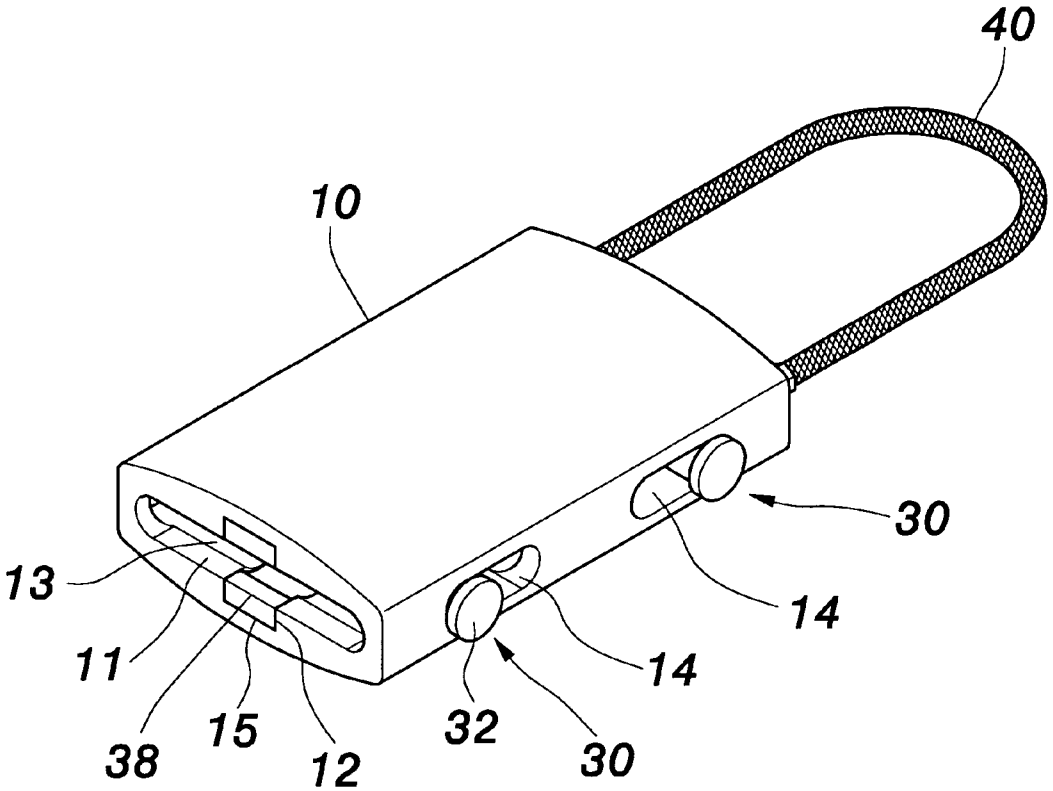
FIG. 4 is an exploded perspective view showing that the present invention is applied to a key ring.
Figure 5:
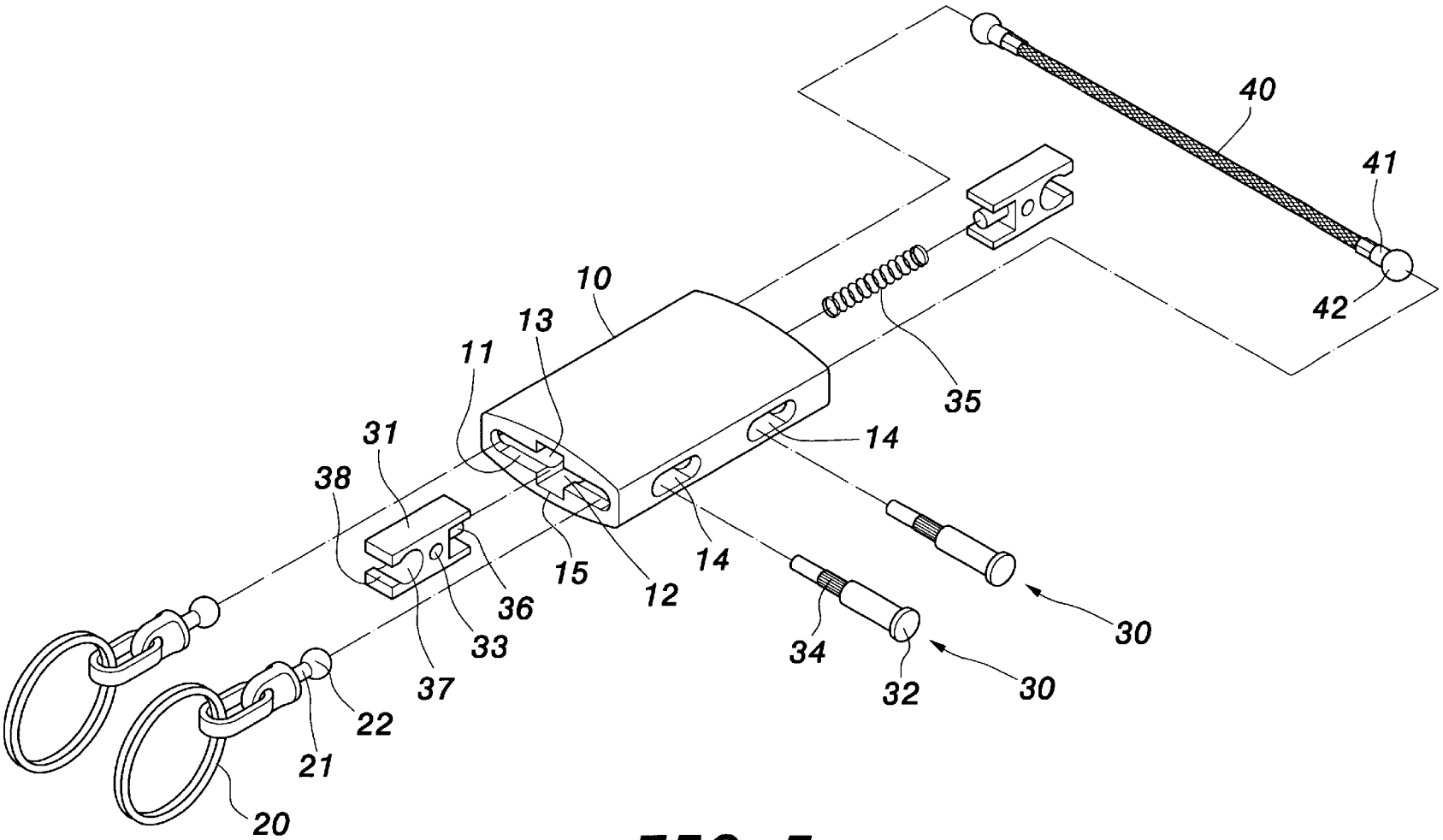
FIG. 5 is an exploded perspective view showing that the present invention is applied to a key ring.
Figure 6:
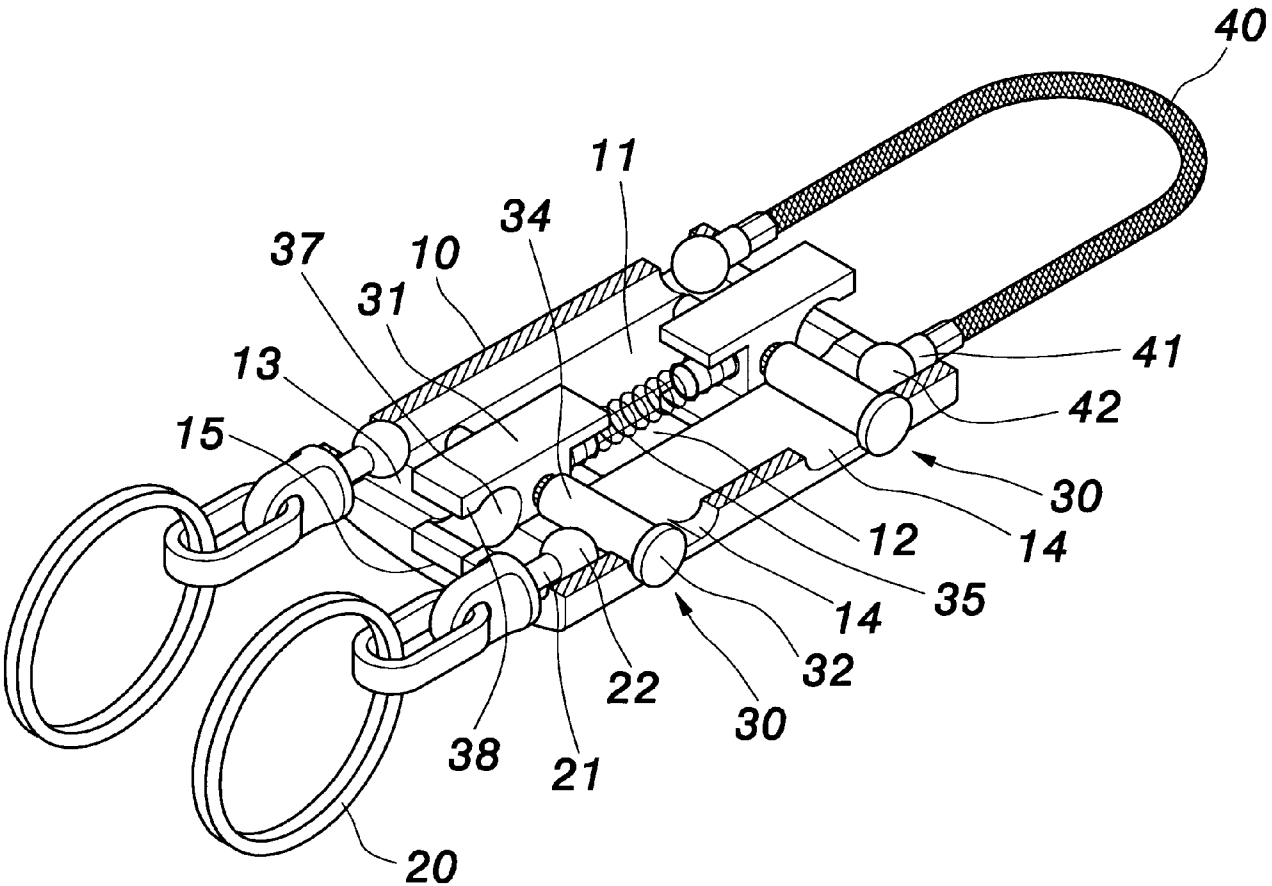
FIG. 6 is a cross sectional view of the key ring in the present invention.

With reference to FIGS. 4, 5 and 6, the seat 10 of the present invention may be combined with a plurality of key hanging rings 20 and at least one control device 30. Each key hanging ring 20 has an arm 21 and a head 22. The key hanging rings 20 serve to be hung with keys (not shown). The head 22 is slidably mounted to the movable track 13 of the seat 10 so that the key hanging rings 20 can be connected to the seat 10 so as to leave with a movable space. Therefore, the head 22 may freely move in the movable track 13. By the opening 15 formed at the sliding groove 12 of the seat 10, the head 22 can be inserted into or taken out from the movable track 13.

The control device 30 is formed by a sliding block 31 and a push button 32. Each sliding block 31 is slidably conformed to one end in the interior of the sliding groove 12. An assembly hole 33 is formed on the sliding block 31. The push button 32 is installed at one side of the seat 10. The interior of the push button 32 is extended with a driven shaft 34. The driven shaft 34 penetrates through the push button through hole 14 to be enforced into the assembling hole 33 of the sliding block 31 so that the sliding block 31 is combined with the push button 32 to be formed as an integral body.

A resilient spring 35 is installed in the seat 10. In this embodiment, the seat 10 is combined with two control devices 30. The resilient spring 35 is installed between two sliding blocks 31 of the two control devices 30, The resilient spring 35 encloses a spring positioning post 36 at one end of the sliding block 31. The resilient spring 35 will eject against one end of the sliding block 31 for pushing the sliding block 31 and push button 32 to move toward the opening 15. Another end of the sliding block 31 is installed with a respective C-channel 37. The head 22 may pass through the C-channel 37 to move freely in the movable track 13. The C-channel 37 transversally extends in the sliding block 31 and has a round cross section. An outer end of the C-channel 37 is connected to a stop 38. The stop 38 of the sliding block 31 is movably matched to the opening 15 for controlling the opening and closing of the opening 15.

Figure 7:
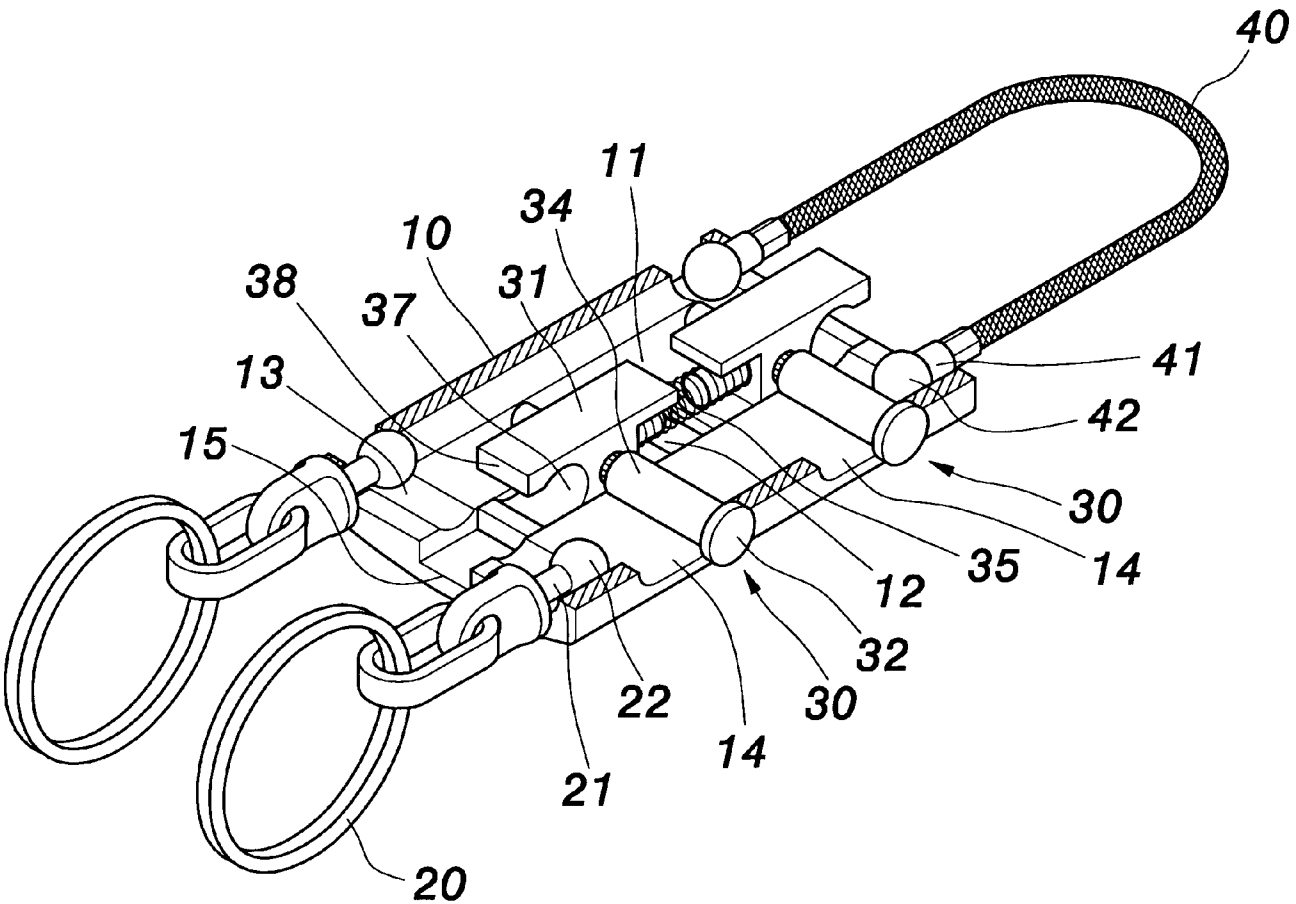
FIG. 7 is a schematic view showing the operation of the present invention being used to a key ring.

Referring to FIG. 7, when the user pushes the push button 32 of the control device 30, the push button 32 will longitudinally move along along the seat 10, toward a reverse direction in the opening 15. The stop 38 at one end of the sliding block 31 and the C-channel 37 will reduce into the interior of the sliding groove 12, i.e., the stop 38 and the C-channel 37 leave from the movable track 13 for opening the movable opening 15. Therefore, the cross section for the channel passing through by the head 22 of the key ring 20 and the arm 21, and thus the head 22 of the key ring 20 can be taken out from or placed into the movable track 13. As a result, the number of the key rings can be selectively adjusted.

Furthermore, the seat 10 can be used to be connected to a hanger 40 which can be used to hang the present invention to the belt of trousers. The hanger 40 is a slender steel rope. Two ends thereof have an arm 41 and a head 42, respectively. The head 42 is slidably mounted to the movable track 13 of the seat 10 and thereby, the hanger 40 can be connected to the seat 10. Thereby, through the opening 15 of the seat 10, the head 42 can be taken out from or placed in the movable track 13.

Figure 8:
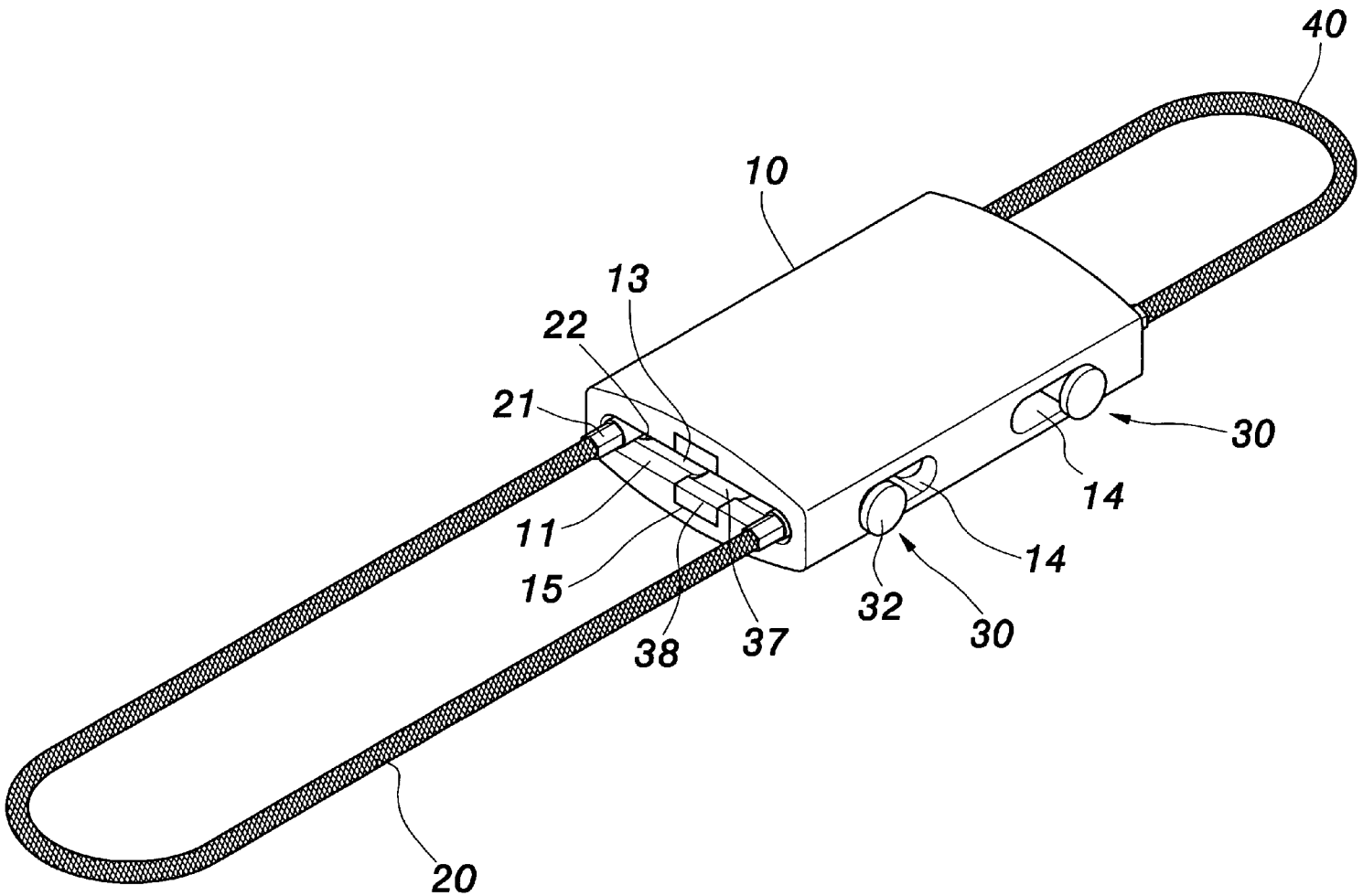
FIG. 8 is a perspective view showing that the present invention is applied to a key ring of another form.

Moreover, referring to FIG. 8, the key ring 20 may be a slender steel rope. Two ends thereof have an arm 21 and a head 22. The head 22 is slidably installed to the movable track 13 of the seat 10 so that the key hanging ring 20 can be connected to the seat 10. Thereby, through the opening 15 of the seat 10, the head 42 can be taken out from or placed in the movable track 13.

The key ring 10 of the present invention has a movable opening 15 being installed in the movable track 13. When a plurality of key hanging rings are positioned in the seat 10 and one of the key hanging rings is to be taken out, that is, the key ring 20 to be taken out is placed at one end of the movable track 13, it is only necessary to push other key rings to another end of the movable track 13, then the key ring 20 to be taken out can be taken out from the movable opening 15. Therefore, the key ring 20 can be taken out easily, and the operation is time and labor saved. Any key ring 20 can be taken out from the opening 15 at the middle section.

Therefore, the defect of the prior art, such as the movable opening is installed at one end of the movable track so that it is hard to take out a key ring and the operation is time and labor wasted, is improved by the present invention.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A seat device of a key ring comprising:

a seat, the seat having an oblong shape, an interior of the seat having a cruciform recess cavity;

a sliding groove being installed in a medial portion of the recess cavity;

one end of the recess cavity being formed with an opening;

a movable track formed interior the recess cavity a predetermined distance form one end thereof;

a push button through hole formed in one side of the seat, the push button through hole extends along the longtitudinal direction of the seat with predetermined length, the push button through hole penetrates into an interior of the recess cavity;

the seat is combined with key hanging rings and control devices;

each key hanging ring is a slender steel rope and has an arm and a head installed at two ends thereof;

the head of the key hanging ring is slidably mounted to the movable track of the seat so that the key hanging ring is connected to the seat;

each control device is formed by a sliding block and a push button;

the sliding block is slidably matched to the sliding groove and the push button is installed at one side of the seat;

a driven shaft extends into the recess cavity and is connected to the sliding block;

a resilient spring serves to push the sliding block and the push button to displace toward the opening;

one end of the sliding block is installed with a C-channel with respect to the moving track so that the head is movable in the moving track;

an outer end of the C-channel is connected to a stop, the stop is movably matched to the opening for controlling the opening and closing of the opening.

2. A seat device of a key ring comprising:

a seat, the seat having an oblong shape, an interior of the seat having a cruciform recess cavity;

a sliding groove being installed in a medial portion of the recess cavity; two ends of the sliding groove are installed with openings; a predetermined distance from each of two ends of an interior of the recess cavity have installed thereon a moving track;

one side of the seat is installed with two push button through holes;

the push button through holes extend along the longitudinal direction of the seat with a predetermined length, the push button through holes penetrate into the interior of the recess cavity;

the seat is combined with key hanging rings and two control devices;

each key hanging ring has an arm and a head;

the head of the key hanging ring is slidably mounted to the moving track of the seat so that the key hanging ring is connected to the seat;

each control device is formed by a sliding block and a push button;

the sliding block is slidably matched to the sliding groove and the push button is installed at the one side of the seat;

a driven shaft extends into the recess cavity is connected to the sliding block; a resilient spring is installed in an interior of the seat, the resilient spring serves to push the sliding block and the push button to displace toward the opening;

one end of the sliding block is installed with a C-channel with respect to the moving track so that the head is movable in the moving track; an outer end of the C-channel is connected to a stop; the stop is movable matched to the opening for controlling the opening and closing of the opening, the seat is connected to a hanger, the hanger is a slender steel rope and two ends thereof have an arm and a head; the head is slidably installed to the moving track of the seat so that the hanger is connected to the seat; through the opening of the seat, the head of the hanger can be taken out from or placed into the moving track.

* * * * *